United States Patent [19]

Young

[11] 4,341,015

[45] Jul. 27, 1982

[54] NAIL CLIPPER ASSEMBLY

[76] Inventor: Patrick Young, 4055 Bismark Dr., San Jose, Calif. 95130

[21] Appl. No.: 303,205

[22] Filed: Sep. 18, 1981

[51] Int. Cl.[3] ..... A45D 29/02

[52] U.S. Cl. ..... 30/28; 132/76.2

[58] Field of Search ..... 30/28, 124; 132/75.4, 132/75.5, 75.6, 76.2

[56] References Cited

U.S. PATENT DOCUMENTS

| | | | |
|---|---|---|---|
| 2,460,522 | 2/1949 | Miller | 30/28 |
| 2,620,560 | 12/1952 | Bahr | 30/28 |
| 2,632,947 | 3/1953 | Hunt et al. | 132/75.6 |
| 2,837,821 | 6/1958 | David | 30/28 |
| 2,887,773 | 5/1959 | Killen | 30/28 |
| 3,031,754 | 5/1962 | Pocoski | 30/28 |
| 3,188,737 | 6/1965 | Chase | 30/124 |
| 3,261,094 | 7/1966 | Bliss | 132/75.5 |
| 3,812,868 | 5/1974 | Keating | 132/75.4 |
| 3,855,698 | 12/1974 | Crosby | 30/124 |
| 3,997,966 | 12/1976 | Sartore | 30/28 |

FOREIGN PATENT DOCUMENTS

| | | | |
|---|---|---|---|
| 2413887 | 10/1975 | Fed. Rep. of Germany | 30/28 |
| 2809220 | 9/1979 | Fed. Rep. of Germany | 132/75.4 |

*Primary Examiner*—Gene Mancene

*Attorney, Agent, or Firm*—Thomas E. Schatzel

[57] ABSTRACT

A clipper assembly for clipping nails, including a nail clipper with a flexible housing attached to the nail clipper for collecting nail clippings during and after operation.

8 Claims, 7 Drawing Figures

NAIL CLIPPER ASSEMBLY

BACKGROUND OF THE INVENTION

1. Field of the Invention

The invention relates generally to nail clippers and more particularly to an improved nail clipper assembly whereby nail clippings are caught and contained.

2. Description of the Prior Art

The conventional lever-operated nail clipper is well known in prior art. Such a device is compact and is designed to be carried in a person's pocket or purse where it is readily available for convenient use. However, no provision in the design of such prior art solves the problem of containing the nail clippings during operation or storing them afterward. It is a common experience of many who use such nail clippers to have nail clippings scatter randomly about as fingernails or toenails are clipped. It is also a common experience to have such nail clippings fall out of the nail clipper, landing on carpets, clothing, and other inappropriate places in general.

Also, with prior art clippers, individuals frequently inadvertently pinch or cut flesh of their fingers or toes, due to the misalignment of the clipper relative to the nails. This frequently occurs when the individual fails to give close attention to the clipping operation or when there is poor lighting during the clipping operation. The inventor is unaware of any previous attempts to remedy these problems.

SUMMARY OF THE PRESENT INVENTION

It is an object of the present invention to provide an improved nail clipper which will prevent the scattering of nail clippings during the operation of the nail clipper.

It is a further object to provide an improved nail clipper which prevents nail clippings from falling from the nail clipper during operation.

It is a further object to provide an improved nail clipper which provides for the storage of nail clippings until appropriate disposal is convenient.

It is a further object to provide an improved nail clipper which serves as guide of the cutting jaws relative to the flesh of the digit (finger or toe) of the nail to be cut.

Briefly, in a preferred embodiment, the present invention includes a length of flexible tubing which is attached to a nail clipper and creates a container which prevents nail clippings from scattering or falling out during the operation of the nail clipper. The flexible tubing can be closed at its end opposite the jaw blades of the nail clipper. The tubing is rigidly attached to the nail clipper at the same point a nail file is normally attached and encloses the entire nail clipper except for the top of the lifting post and the lever arm which projects through a pre-cut opening in the flexible tubing to allow operation of the nail clipper. During operation, any clippings which, without the tubing, would normally be propelled or fall from the nail clipper are prevented from doing so by the tubing and remain therein until the tubing is emptied by the operator. The jaw blade end of the flexible tubing can be temporarily closed by a cap to prevent stored clippings from exiting the flexible tubing until disposal is convenient.

The terminal edge of the tubing about the jaw blades is positioned and shaped so as to serve as a guide to the digit (finger or toe) of the nail to be clipped. With the digit in abutment with the terminal edge, the flesh of the digit is precluded from the confines of the jaw blades.

An advantage of a nail clipper assembly of the present invention is that the scattering of nail clippings during operation is prevented.

Another advantage of the nail clipper assembly of the present invention is that it provides for storage of nail clippings after operation.

A further advantage is that nail clippings are prevented from falling from the nail clipper during operation.

A further advantage is that it provides a guide and avoids pinching and/or lacerating the flesh of the digit of the nail being clipped.

A further advantage of the present invention is that the lever arm may be utilized in any radial position without interference from the housing.

A further advantage of the present invention is that the nail file may be positioned at any radial position without any interference from the housing.

These and other objects and advantages of the present invention will no doubt become obvious to those of ordinary skill in the art after having read the following detailed description of the preferred embodiment which is illustrated in the various drawing figures.

IN THE DRAWING

DETAILED DESCRIPTION OF THE PREFERRED EMBODIMENT

Figure 1:
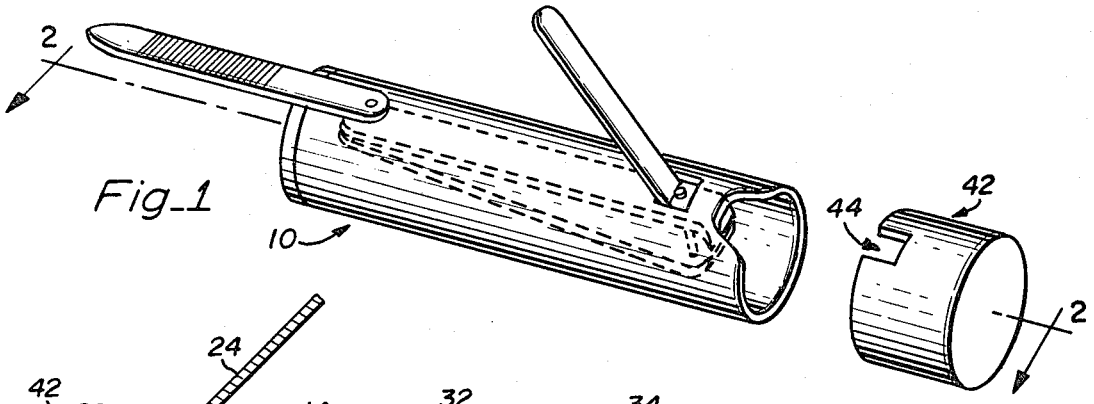
FIG. 1 is a perspective view of a nail clipper assembly of the present invention.
Figure 2:
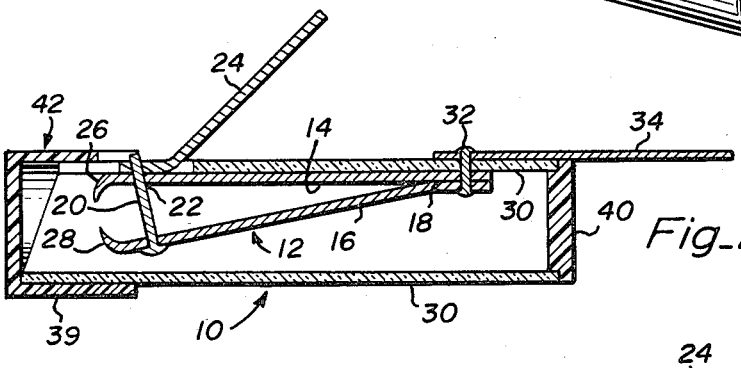
FIG. 2 is a cross-sectional view of the nail clipper assembly of FIG. 1 taken along line 2—2 with the cap in place.
Figure 3:
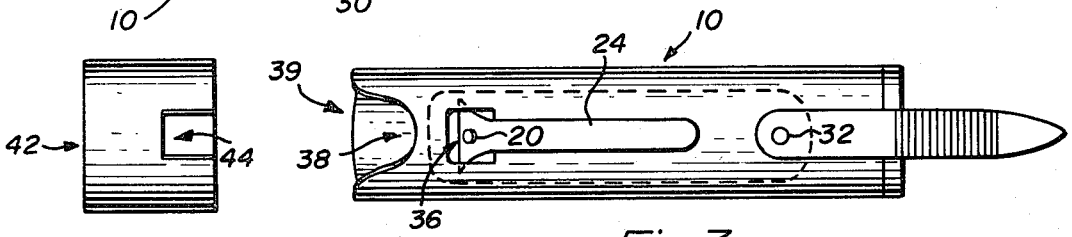
FIG. 3 is a top elevational view of the nail clipper assembly of FIG. 1.

In FIG. 1, there is illustrated an improved nail clipper assembly referred to by the general reference numeral 10 and incorporating the present invention. As illustrated in FIG. 2, the improved nail clipper assembly 10 includes a nail clipper 12 having an upper blade arm 14 connected to a lower blade arm 16 by a weld 18. A lifting post 20 is attached to the lower blade arm 16 and extends upward through an aperture 22 in the upper blade arm 14 where it is pivotally attached to a lever arm 24. At the ends of the upper blade arm 14 and lower blade arm 16 opposite the weld 18 are the upper jaw blade 26 and the lower jaw blade 28. A flexible housing 30 is attached to the clipper 12 by a fastener 32 extending through a ridged blade 34 and the blade arms 14 and 16 adjacent the weld 18. A rectangular shaped opening 36 is made in the flexible housing 30, leaving the upper portion of the lifting post 20 and the lever arm 24 uncovered by the flexible housing 30. The opening 36 is generally a square cross-section with the natural width being less than the width of the lever arm 24 at the point the lever arm 24 is coupled to the lifting post 20. Thus, at the point of intersection of the lever arm 24 with the walls of the opening 36, the housing 30 is placed under compression. The terminal end of the flexible housing 30 is contoured to create a notch 38 adjacent to the jaw blades 26 and 28. Opposite the notch 38 is a tab 39 which projects longitudinally relative to the notch 38. The flexible housing 30 is closed at the end opposite of the upper jaw blade 26 and lower jaw blade 28 by a plug 40. The flexible housing 30 is capped at the end opposite plug 40 by a cap 42 having an inside dimension slightly larger than the outside dimension of housing 30 such that cap 42 fits snugly over housing 30. Cap 42 is adapted to fit around lifting post 20 and lever arm 24 by a slot 44. The cap 42 is in place, as illustrated in FIG. 2, when nail clipper 12 is not in use. The cap 42 may be connected to the flexible housing 30 or plug 40 by a flexible connecting means (not shown) to prevent loss of cap 42 when it is removed from clipper operation.

During operation for cutting fingernails, the operator places the finger with the nail to be clipped about the notch 38 in an abutment with the tab 39, such that the end of the fingernail extends into the gap between the upper jaw blade 26 and the lower jaw blade 28. The fingernail is clipped by actuating the lever arm 24 which causes lifting post 20 to rise, closing lower jaw blade 28 onto upper jaw blade 26 and clipping the fingernail.

The clippings, as they exit the area of the upper and lower jaw blades 26, and 28, strike the inner wall of the flexible housing 30 and are thus contained inside the flexible housing 30. Similarly, any clippings which have the tendency to remain behind the upper jaw blade 26 and lower jaw blade 28 after clipping are retained within the flexible housing 30 for removal at a convenient time.

Figure 7:
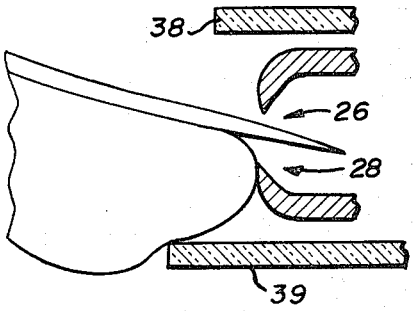
FIG. 7 is a partial cutaway view of FIG. 2 showing the guide and jaw blades in operation.

As illustrated in FIG. 7, the tab 39 engages the flesh of the digit to be clipped. With its protrusion beyond the jaw blades 26 and 28, it serves as a guide to the individual so that the cut is not too deep on the nail and thereby result in the pinching or lacerating of the flesh. Thus, even in darkness or bad lighting, the user can perform the nail clipping operation solely on feel.

The flexible housing 30 is illustrated in the form of a cylindrical tubing. As such, if forms a continuous, smooth outer surface such that it may be readily carried in the pocket or purse of an individual. The smooth, continuous surface assists in minimizing snagging of the assembly with other items in the pocket or purse. Also, with the jaw blades 26 and 28 recessed relative to the tab 39, snaring of the jaw blades with other items in the pocket or purse is further negated.

The housing 30 is preferably of a flexible material so that the lever arm may be readily rotated about the lifting post 20. As such, when the side walls about the opening 36 of the housing 30 come into contact with the lever arm 24, the housing tends to distort so as to allow the arm to be pivoted. At the same time, when the lever arm 24 is rotated out of contact with the side walls, the housing springs back in place and thus forms a relatively snug seal about the upper blade arm 14. Thus, the lever arm 24 may be readily actuated in any position without interference from the housing 30. With the housing 30 placed intermediate the ridged blade 34 and the upper blade arm 14, it permits the ridged blade 34 to be readily used without any interference from the housing. The ridged blade 34 may be used in the form of a nail file. It may thus be positioned readily at any position about the fastener 32 without any interference from the housing.

The flexible housing 30 is preferably of a clear material which is transparent to the human eye, thus permitting visual observation of the position of the nail to be clipped relative to the jaw blades 26 and 28.

Figure 4:
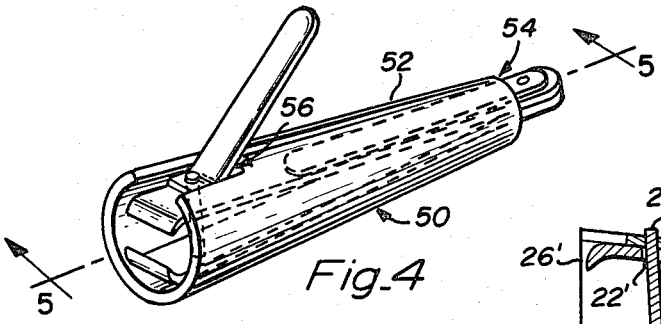
FIG. 4 is a perspective view of an alternative embodiment of the invention.
Figure 5:
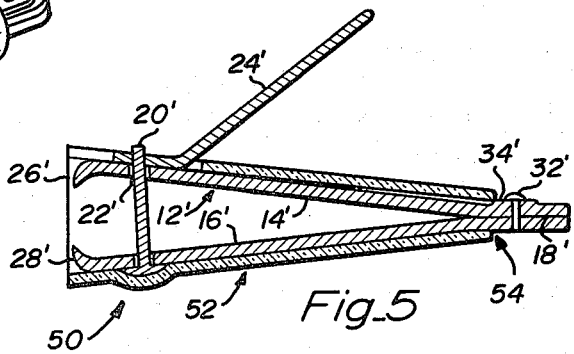
FIG. 5 is a cross-sectional view of the alternative embodiment of the invention of FIG. 4 taken along line 5—5.
Figure 6:
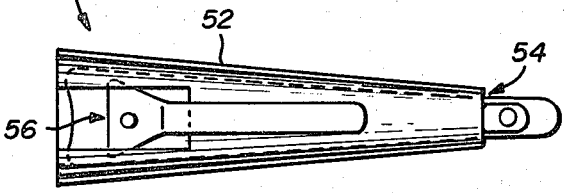
FIG. 6 is a top elevational view of the alternative embodiment of the invention of FIG. 4.

FIGS. 4, 5 and 6 illustrate another embodiment of the present invention referred to by the general reference numeral 50. Those elements common to the elements previously described carry the same reference numeral and are distinguished by a prime designation. In the assembly 50, the clipper 12' is supported by a housing 52 which is a truncated cone. As such, the housing 52 tapers to an opening 54 through which the weld 18' end of nail clipper 12' projects. The opposite end of housing 52 is adapted to slide over nail clipper 12' by a slot 56 which allows lifting post 20' and lever arm 24' to be bordered by housing 52 on three sides. The material of the housing 52 is preferably a pliable material. A cap may also be fitted over the jaw blade end of assembly 50.

Although the present invention has been described in terms of the presently preferred embodiment, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

I claim:

1. A clipper assembly for clipping nails having an upper and a lower blade arm with a jaw blade at a first end of each, a lifting post and a lever arm wherein the lower blade arm is rigidly joined to the upper blade arm at a second end opposite of the jaw blades, and the lifting post is connected to the lower blade arm and extends upward through an aperture in the upper blade arm where the lever arm is pivotally connected to the lifting post and said lever arm can rotate about the axis of said lifting post and about an axis normal to the axis of said lifting post, the improvement comprising of a flexible housing having a first and second end of inside cross-sectional dimension exceeding the widest dimension of said blade arms and a longitudinal dimension exceeding the length of said blade arms, the housing being positioned about said upper and lower blade arms;

a ridged blade pivotally connected to said blade arms by a fastener post extending through said blade arms about said second end and the flexible housing near said second end; the ridged blade being positioned about the exterior of the housing; and an opening in the flexible housing near said first end such that said lever arm and lifting post are uncovered by the flexible housing.

2. The clipper assembly of claim 1 wherein said first end of the flexible housing extends beyond the first end of said blades and having a contoured finger groove adjacent said first end of the blade arms.

3. The clipper assembly of claim 1 wherein the housing has a projecting tab adjacent the first end of the blade arms and radially offset relative to said countoured groove.

4. The clipper assembly of claim 1 wherein the opening is generally of a rectangular cross-section with the distance between the side walls less than the width of the lever arm where said lever arm is joined to the lifting post.

5. The clipper assembly of claims 1, 2, 3 or 4 wherein the housing is of a right cylinder.

6. The clipper assembly of claims 1, 2 or 4 wherein the housing is of a truncated conical shape tapering toward said second end of said blade arms.

7. The clipper assembly of claims 1, 2, 3, or 4 wherein the housing is constructed of a clear material transparent to the human eye.

8. The clipper assembly of claim 1 further including means for temporarily closing said first end of the flexible housing.

* * * * *